US007588525B2

(12) United States Patent
Longworth et al.

(10) Patent No.: US 7,588,525 B2
(45) Date of Patent: Sep. 15, 2009

(54) TAB FOLDING AND SEALING APPARATUS AND METHOD

(75) Inventors: Paul Longworth, Wantage (GB); Jason John Hall, Sandford-on-Thames (GB)

(73) Assignee: Crown Packaging Technology, Inc., Alsip, IL (US)

( * ) Notice: Subject to any disclaimer, the term of this patent is extended or adjusted under 35 U.S.C. 154(b) by 213 days.

(21) Appl. No.: 11/574,690

(22) PCT Filed: Sep. 9, 2005

(86) PCT No.: PCT/EP2005/054484

§ 371 (c)(1),
(2), (4) Date: Mar. 5, 2007

(87) PCT Pub. No.: WO2006/029991

PCT Pub. Date: Mar. 23, 2006

(65) Prior Publication Data

US 2008/0092485 A1 Apr. 24, 2008

(30) Foreign Application Priority Data

Sep. 13, 2004 (EP) ..... 04255525

(51) Int. Cl.
*B31B 1/64* (2006.01)

(52) U.S. Cl. ..... 493/135; 493/108; 493/80; 53/133.1; 53/133.7

(58) Field of Classification Search ..... 493/183, 493/245, 408, 135, 108, 109, 79, 80; 53/133.1, 53/133.3, 133.7; 215/232, 254, 347, 349
See application file for complete search history.

(56) References Cited

U.S. PATENT DOCUMENTS

| | | | | |
|---|---|---|---|---|
| 2,801,040 | A | 7/1957 | Meyer-Jagenberg | |
| 2,901,994 | A * | 9/1959 | Wheeler | 413/67 |
| 3,973,719 | A * | 8/1976 | Johnson et al. | 229/5.6 |
| 4,095,390 | A * | 6/1978 | Knudsen | 53/329.4 |
| 4,155,439 | A * | 5/1979 | Fletcher et al. | 198/339.1 |
| 4,230,028 | A * | 10/1980 | Knudsen | 493/76 |
| 4,280,653 | A * | 7/1981 | Elias | 229/123.1 |
| 4,526,562 | A * | 7/1985 | Knudsen et al. | 493/80 |
| 4,544,080 | A | 10/1985 | Wright et al. | |
| 4,834,259 | A * | 5/1989 | Kubis et al. | 220/359.2 |
| 4,915,254 | A | 4/1990 | Zumsteg | |
| 5,141,594 | A | 8/1992 | Walter et al. | |
| 5,277,722 | A | 1/1994 | Block et al. | |
| 5,797,509 | A * | 8/1998 | Fitch | 220/258.2 |
| 6,129,268 | A | 10/2000 | Stahlecker | |

(Continued)

FOREIGN PATENT DOCUMENTS

EP 0090957 A2 12/1983

(Continued)

*Primary Examiner*—Hemant M Desai
(74) *Attorney, Agent, or Firm*—Knoble Yoshida & Dunleavy, LLC

(57) ABSTRACT

A method and apparatus for folding a tab over a peelable panel on an end structure comprising a ring/panel. The ring and panel are formed from the same flexible material which has no inherent deadfold characteristic. In one embodiment an upper tab fold tool includes a pivotable plate for holding the folded edge of the tab in position prior to heat sealing to the peelable panel.

10 Claims, 3 Drawing Sheets

U.S. PATENT DOCUMENTS 6,161,367 A 12/2000 Walter
6,174,274 B1 * 1/2001 Hawkins et al. ..... 493/77

FOREIGN PATENT DOCUMENTS

EP 1065145 A1 3/2001
EP 1386852 A1 4/2004
WO 99/35045 A1 7/1999
WO 01/07330 A1 2/2001

* cited by examiner

[Fig. 001]
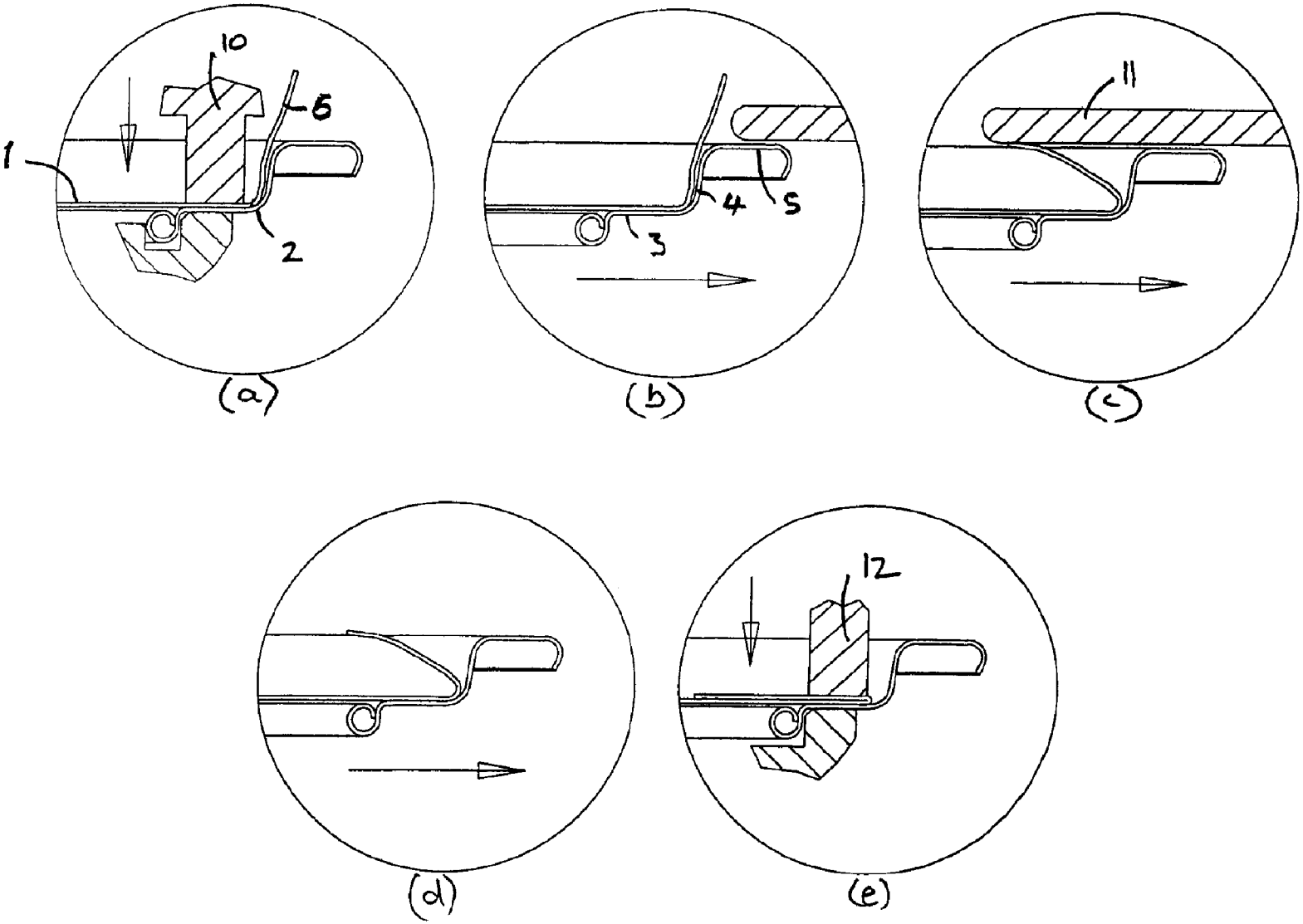

[Fig. 002]
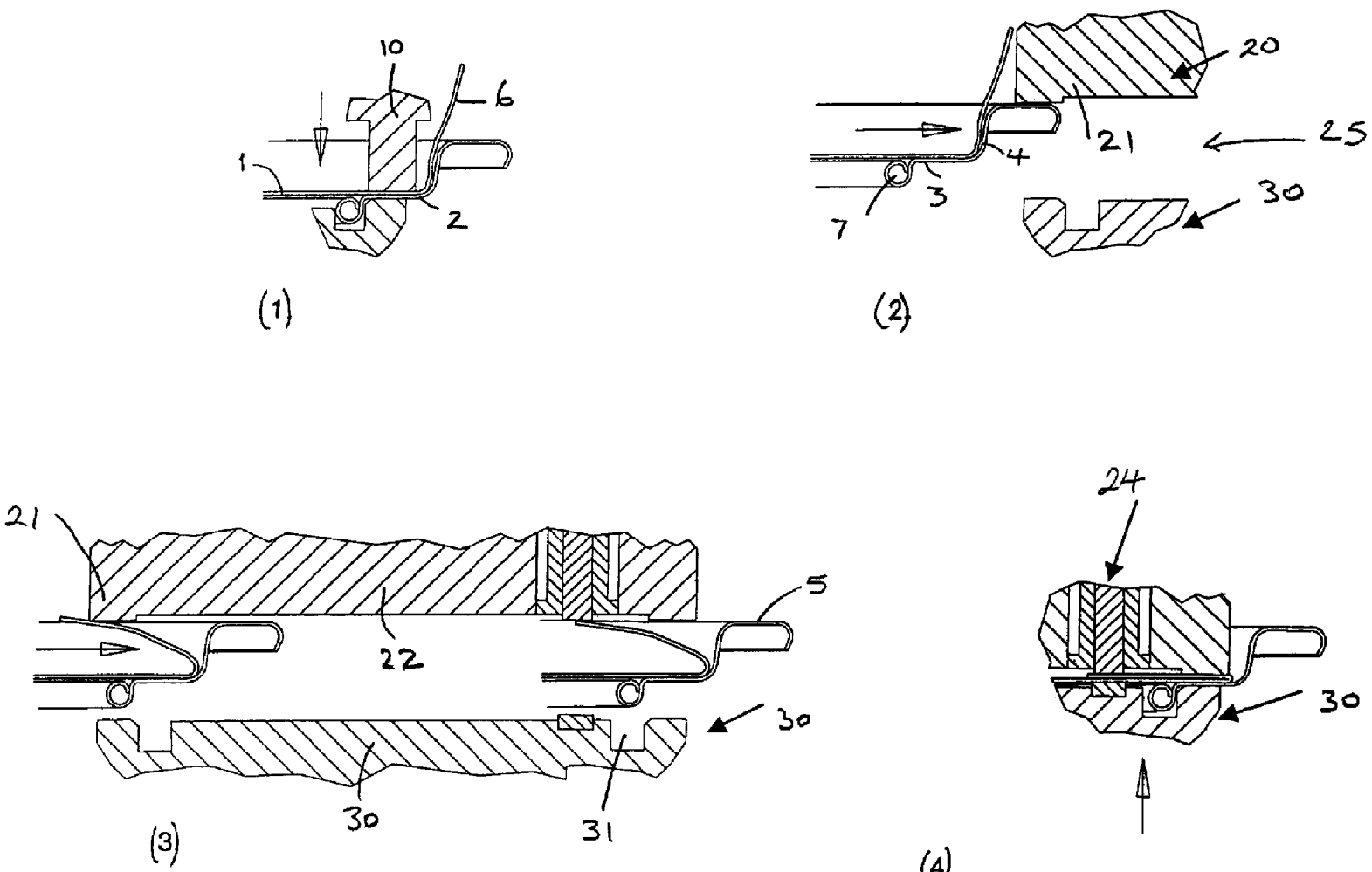

[Fig. 003]
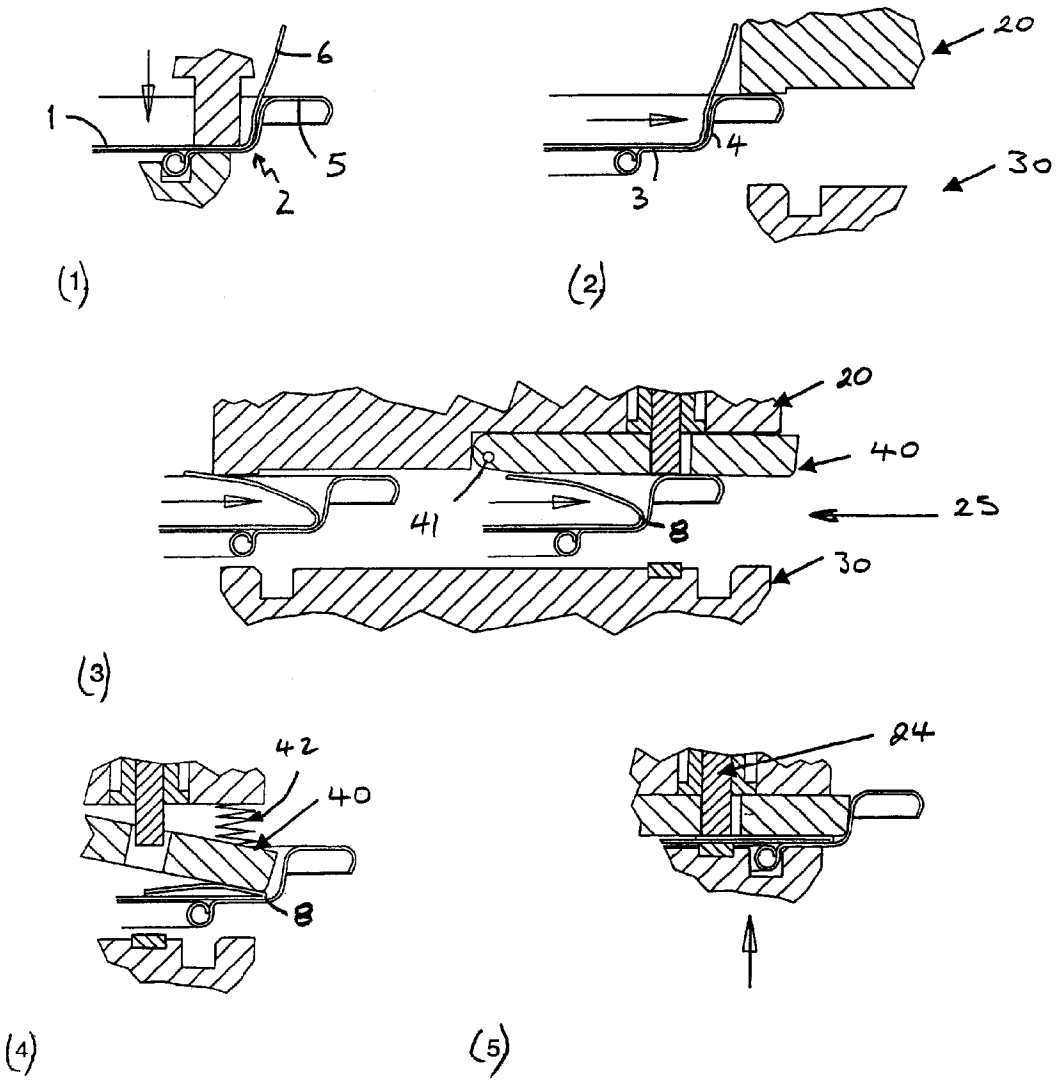

TAB FOLDING AND SEALING APPARATUS AND METHOD

This Application is the U.S. national phase of International Application No. PCT/EP2005/54484 filed on Sep. 9, 2005.

TECHNICAL FIELD

This invention relates to tab folding. In particular it relates to an apparatus for folding a tab over a peelable lid structure on a container.

BACKGROUND ART

Tabs are in general use for the removal of peelable panels and typically are formed from a projection of the panel. By grasping the tab, the panel can be peeled off a container. The material of the peelable panel and integral tab typically comprises a laminate structure, which may include a heat sealable layer and a barrier layer such as aluminium and/or varnish. In closures on containers for food products which require processing by retorting, for example, the tab may be folded over the main part of the panel in order to avoid handling problems. Often the peelable panel is fixed to a metal ring which is then seamed to the edge of a can body. In order to avoid damage to the tab, particularly during processing, it is usual to fold the tab radially inwardly away from the ring prior to the seaming operation.

Folding the tab of a peelable panel which includes a thick layer of aluminium can be carried out in a relatively straightforward manner by using the material's inherent deadfold properties. A typical folding process for such a tab/panel is carried out in three steps as shown in FIG. 1. Firstly the peelable panel 1 is fixed to a metal ring 2 by heat sealing (FIG. 1(*a*)). The ring 2 includes a flat annulus 3, an upright wall 4 and a seaming panel 5. During heat sealing, the tab 6 is forced by the heat sealing tool 10 around the wall 4 at the side of the ring so as to lie in a position approximately perpendicular to the centre part of the peelable panel. In a second operation, a folding tool 11 passes laterally over the seaming panel (FIG. 1(*b*)) until it contacts the tab and folds the tab 6 over the annulus 3 of the ring 2 and main part of panel 1 (FIG. 1(*c*)). When the tool 11 is removed, deadfold in the tab/panel material maintains the tab 6 in its folded position (FIG. 1(*d*)). Finally, a press tool 12 crushes the tab flat against the rest of the peelable panel 1 (FIG. 1 (*e*)).

This prior art folding method is only suitable for material which has inherent deadfold properties, typically including an aluminium layer of around 70 μm (microns) in thickness. In all types and thicknesses of lidding material, the tab has to stay on, or very close to the lid panel to avoid being damaged during handling and/or seaming. With flexible material structures, the lidding may be a three or four layer structure using less than 30 μm (microns) or at most 40 microns of aluminium, typically 0 to 10 μm. Not only would the tab crush operation of FIG. 1(*e*) fail to maintain the tab of such flexible lidding structures in the desired folded position, but flexible tab material adjacent the upright wall and seaming panel of the ring 2 is free to move and tends to wrinkle or to develop a fold in a non-ideal position during the folding and "crushing" operations (FIGS. 1(*d*) and (*e*)), thus risking damage to the tab.

This invention seeks to provide a method and apparatus for use with ends in which the tab and lid structure are formed from the same flexible material, which has no inherent deadfold characteristic.

DISCLOSURE OF INVENTION

According to the present invention, there is provided an apparatus for folding a tab of flexible material over a peelable panel, in which the tab and peelable panel are formed from a single piece of the same flexible material which has no inherent deadfold characteristic and which, in use, is fixed to a ring or container body such that the tab extends away from the panel, the apparatus comprising: an upper tab fold tool having two independent and distinct regions comprising: a first region for folding the tab; and a second region including a biasing device for flattening the folded tab against the peelable panel; a lower tab fold tool; and a heat seal stake; and in which either or both of the fold tools are moveable axially relative to each other for folding the tab against the peelable panel and the heat seal stake is provided in the upper tab fold tool for bonding the folded tab in its folded position.

By combining the tab fold and heat seal stake in a single tool, lidding material with no inherent deadfold can be handled and subjected to subsequent thermal processing without risk of damaging the tab.

The peelable panel is fixed to a flat annulus of the ring or a container body to form the peelable end structure. An upright wall of the ring or container body extends away from the annulus to a seaming panel. Ideally, the biasing device flattens the folded edge of the tab against the peelable panel prior to folding the remainder of the tab flat against the peelable panel. This prevents the tab from moving and avoids bonding of the folded tab in a position in which the folded edge extends beyond the flat annulus and around the upright wall.

The biasing device may include a pivotable plate which is held against the tab fold upper tool by the seaming panel such that lateral movement of the lidding material relative to the apparatus releases the pivotable plate for flattening the folded edge of the tab against the peelable panel.

Typically the apparatus further comprises a heat seal tool for fixing the peelable panel to a ring although this tool may alternatively be completely separate from that for tab folding and heat sealing of the tab.

According to another aspect of the present invention, there is provided a method of folding a tab of flexible material over a peelable panel, the method comprising: providing an upper tab fold tool, a lower tab fold tool and a heat seal stake; moving either or both of the tab fold tools axially relative to each other and folding the tab against the peelable panel by a first step of folding the tab; and a second step of flattening the folded edge of the tab against the panel prior to folding and flattening the remainder of the tab flat against the panel; and moving the heat seal stake into contact with the folded tab and bonding the folded tab in its folded position.

Prior to folding and flattening the tab to the panel the method may further comprise fixing the panel to a ring with the unbonded tab extending away from the remainder of the panel and adjacent a seaming panel of the ring. The method may, in an alternative embodiment, comprise fixing the panel directly to a container with the unbonded tab extending away from the remainder of the panel and adjacent a seaming panel of the container body.

In a preferred embodiment, the method further comprises providing a biasing plate in the upper tab fold tool; moving the ring/panel structure and upper tab fold tool relative to each other, a seaming panel of the ring holding the biasing plate against the upper tab fold tool; moving the ring/panel structure and apparatus relative to each other, and releasing the biasing plate, flattening the tab edge against the panel and bonding the tab onto the peelable panel. Typically, the biasing plate is pivotable and/or spring loaded.

BRIEF DESCRIPTION OF THE DRAWINGS

Preferred embodiments of the invention will now be described with reference to the drawings, in which:

FIG. 1 is the prior art tab folding apparatus described above;

FIG. 2 which is a schematic side view of a first embodiment of apparatus for tab folding; and FIG. 3 is a schematic side view of a second embodiment of tab folding apparatus.

MODE FOR THE INVENTION

In all the embodiments of FIGS. 1 to 3, the peelable panel 1 is fixed to a metal ring 2 by heat sealing. The ring 2 includes a flat annulus 3, an upright wall 4 and a seaming panel 5. During heat sealing, the tab 6 is forced by the heat sealing tool 10 around the wall 4 at the side of the ring so as to lie in a position approximately perpendicular to the centre part of the peelable panel. The end structure of FIGS. 2 and 3 has a peelable panel which is formed from flexible material having a laminated structure with 0 to 40 μm (microns) of aluminium and includes a heat sealable material on its outer surface for bonding the tab in its folded position.

In a second operation, upper tab fold tool 20 passes laterally over the seaming panel until it contacts the tab 6 and folds the tab over the annulus 3 of the ring 2 and main part of panel 1. However, in contrast with the prior art of FIG. 1, upper tab fold tool 20 of the present invention combines tab fold, crush and heat seal in a single tool 20 for use with flexible lidding materials.

In the embodiment of FIG. 2, upper tab fold tool 20 comprises a first portion 21 for folding the tab 6 over the peelable panel 1 (FIG. 2(2)). During relative axial movement of ring/panel and tool 20, a "letterbox" 25 is formed between upper tab fold tool 20 and lower tab fold tool 30. As the ring/panel pass laterally through the letterbox 25, portion 21 of the upper tab fold tool passes with minimum clearance over the seaming panel and folds the tab 6 over the peelable panel 1. Minimising clearance avoids wrinkling of the flexible lidding material or folding the tab in a non-ideal position such that the fold is too close to the countersink wall, resulting in the folded edge extending to the upright wall.

Central region 22 of the upper tab fold tool 20 maintains the tab in its folded position as the ring passes through the letterbox 25. FIG. 2(3) shows two ring/panel structures in folding and crushing positions for clarity only. In reality these operations are carried out with a single ring/panel in the apparatus at any one time.

When the ring/panel structure reached the position at the right hand side of FIGS. 2(3) and 2(4), the upper tab fold tool crushes the tab 6 and heat seal stake 24 bonds the tab down onto peelable panel 1. This operation may be achieved either by downward movement of the upper tab fold tool, upward movement of the lower tab fold tool (lifting the ring/panel structure) as indicated by the arrow in FIG. 2(4), or a combination of these relative movements. Curled edge 7 of the ring 2 fits into a recess 31 in lower tab fold tool 30 for crushing and heat sealing.

The upper tab fold tool 20 of the embodiment of FIG. 3 includes a plate 40 which is pivotable about point 41 as shown on FIG. 3(3). As the ring/panel structure advances through letterbox 25, pivotable plate 40 is lifting against the upper tab fold tool 20 by seaming panel 5, against the action of spring 42. Further forward movement releases the pivot plate so that it drops and folds the "edge" 8 of tab 6. This edge 8 is thus prevented from movement around the ring 2 and/or up the wall 4 of the ring and improves consistency of the folded position of the tab.

In FIG. 3(5), the end is lifted up and the whole tab is folded flat. Heat seal stake 24 bonds the tab in position. Residual heat in the material from the initial sealing of the flexible lidding panel to the ring may "tack" the tab in place prior to the final heat seal stake. The tab fold plate 20 also acts as a stripper for removal of the heat seal stake.

The invention has been described above by way of example only and changes may be made to the method/apparatus within the scope of the invention. For example, the upper tab fold tool (including such features as heat seal stake or pivot plate) may be configured so as to fix tabs having a variety of profiles. Biasing devices other than spring 40 may be used.

Although the use of an intermediate ring structure to which the peelable panel is bonded prior to seaming of the ring to a can body is shown in the drawings, the invention is applicable to any container which is closed by a peelable panel with integral tab. For example, the peelable panel could be on an end or directly attached to the container body.

The invention claimed is:

1. An apparatus for folding a tab of flexible material over a peelable panel, in which the tab and peelable panel are formed from a single piece of the same flexible material which has no inherent deadfold characteristic and which, in use, is fixed to a ring such that the tab extends away from the panel, the apparatus comprising:

an upper tab fold tool having two independent and distinct regions comprising:

a first region for folding the tab; and a second region including a biasing device for flattening the folded tab against the peelable panel;

a lower tab fold tool; and a heat seal stake; and in which either or both of the fold tools are moveable axially relative to each other for folding the tab against the peelable panel and the heat seal stake is provided in the upper tab fold tool for bonding the folded tab in its folded position.

2. An apparatus according to claim 1, in which the biasing device flattens the folded edge of the tab against the peelable panel prior to folding the remainder of the tab flat against the peelable panel.

3. An apparatus according to claim 1 or claim 2, in which the biasing device includes a pivotable plate which is held against the tab fold upper tool by a seaming panel of the ring such that lateral movement of the lidding material relative to the apparatus releases the pivotable plate for flattening the folded edge of the tab against the peelable panel.

4. An apparatus according to any one of claims 1 to 3, further comprising a heat seal tool for fixing the peelable panel to a ring.

5. The apparatus according to claim 1, wherein the lower tab tool has a recess adapted to fit a curled edge of a ring/panel structure.

6. A method of folding a tab of flexible material over a peelable panel, the method comprising:

providing an upper tab fold tool, a lower tab fold tool and a heat seal stake; providing a biasing plate in the upper tab fold tool for flattening the folded tab against the peelable panel, wherein the peelable panel has no inherent deadfold characteristic;

moving either or both of the tab fold tools axially relative to each other and folding the tab against the peelable panel by:

a first step of folding the tab; and a second step of flattening the folded edge of the tab against the panel prior to folding and flattening the remainder of the tab flat against the panel; and moving the heat seal stake into contact with the folded tab and bonding the folded tab in its folded position.

7. A method according to claim 6, further comprising fixing the panel to a ring or a container body with the unbonded tab extending away from the remainder of the panel and adjacent a seaming panel of the ring or container body, prior to folding and flattening the tab to the panel.

8. A method according to claim 7, further comprising:

moving the ring/panel structure and upper tab fold tool relative to each other, a seaming panel of the ring holding the biasing plate against the upper tab fold tool;

moving the ring/panel structure and apparatus relative to each other;

releasing the biasing plate;

flattening the tab edge against the panel; and bonding the tab onto the peelable panel.

9. A method according to claim 8 in which the biasing plate is pivotable and/or spring loaded.

10. The method of claim 6, wherein the lower tab tool has a recess adapted to fit a curled edge of the ring/panel structure.

* * * * *